US006267587B1

(12) United States Patent
Bishop et al.

(10) Patent No.: US 6,267,587 B1
(45) Date of Patent: Jul. 31, 2001

(54) THERMAL CURING OVEN AND THERMAL CURING PROCESS

(75) Inventors: Joseph A. Bishop, Salem; Gary Marcau, Roanoke; Venkatramani Iyer, Roanoke; Brian McCrady, Roanoke, all of VA (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

(21) Appl. No.: 09/610,777

(22) Filed: Jul. 6, 2000

(51) Int. Cl.[7] ..... F27B 9/02

(52) U.S. Cl. ..... 432/121; 432/128; 432/133; 432/145; 414/147; 414/157

(58) Field of Search ..... 432/9, 34, 121, 432/126, 128, 133, 137, 145; 414/147, 150, 157, 160; 264/1.1, 1.36, 2.7

(56) References Cited

U.S. PATENT DOCUMENTS 5,421,320 * 6/1995 Brown ..... 126/19 R
5,875,705 * 3/1999 Knost ..... 432/145
6,062,850 * 5/2000 Ino et al. ..... 432/128

* cited by examiner

*Primary Examiner*—Gregory Wilson

(57) ABSTRACT

An apparatus and a method for curing coatings on ophthalmic lenses is disclosed. The apparatus includes an oven that is continuously supplied with lenses. A vertically oriented conveyor having multiple carrier bars for supporting the lenses is positioned within the oven. The conveyor moves the lenses through a series of positions within the oven where the lenses are subjected to heat. Ambient air is filtered and forced into the oven by an intake blower which keeps the air pressure within the oven above the ambient air pressure. Air is recirculated and filtered within the oven by recirculation blowers. Air is exhausted from the oven by an exhaust blower which effects air exchange with the ambient.

24 Claims, 12 Drawing Sheets

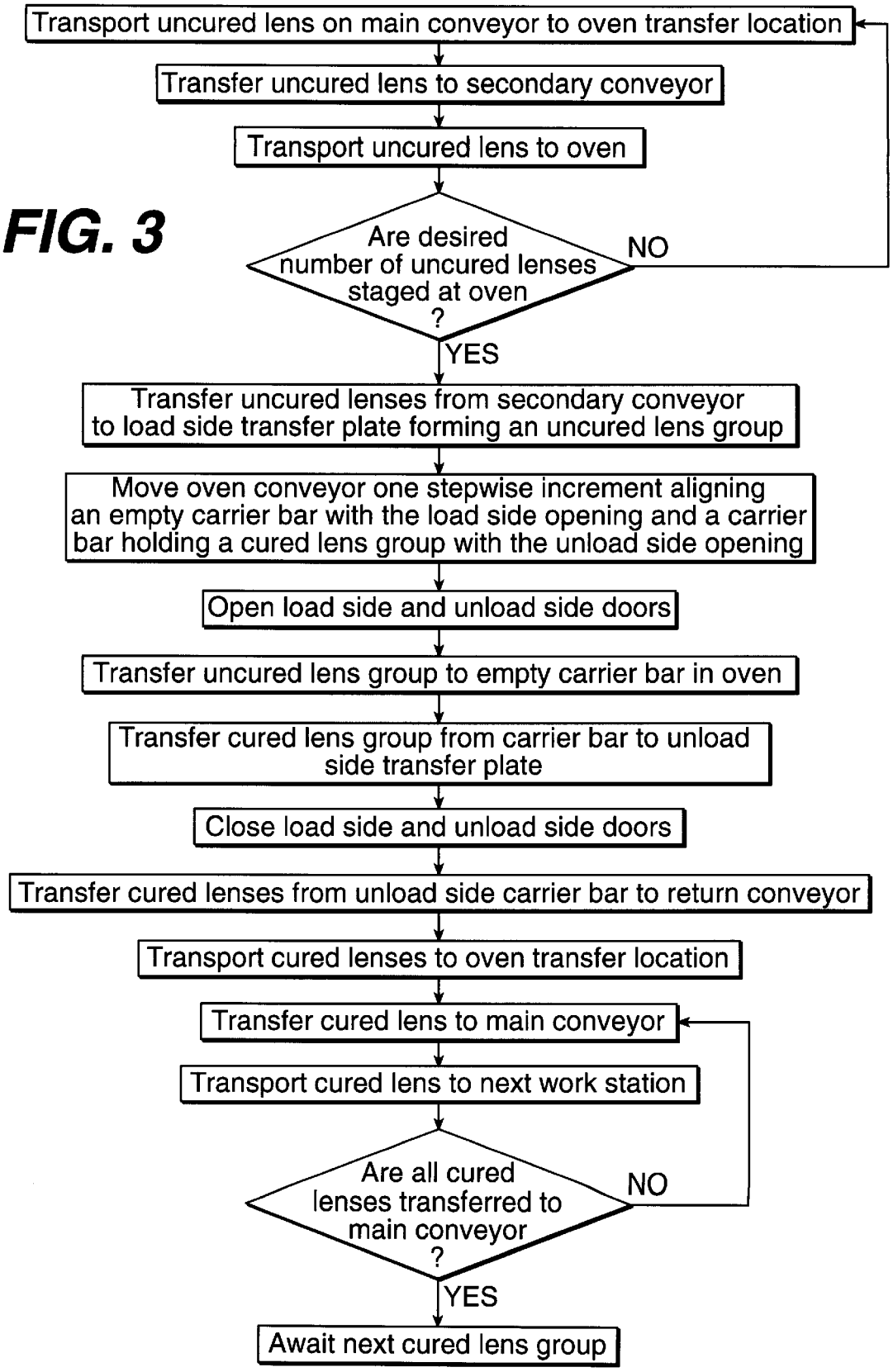
FIG. 3
Transport uncured lens on main conveyor to oven transfer location
Transfer uncured lens to secondary conveyor
Transport uncured lens to oven
Are desired number of uncured lenses staged at oven ?
NO
YES
Transfer uncured lenses from secondary conveyor to load side transfer plate forming an uncured lens group
Move oven conveyor one stepwise increment aligning an empty carrier bar with the load side opening and a carrier bar holding a cured lens group with the unload side opening
Open load side and unload side doors
Transfer uncured lens group to empty carrier bar in oven
Transfer cured lens group from carrier bar to unload side transfer plate
Close load side and unload side doors
Transfer cured lenses from unload side carrier bar to return conveyor
Transport cured lenses to oven transfer location
Transfer cured lens to main conveyor
Transport cured lens to next work station
Are all cured lenses transferred to main conveyor ?
NO
YES
Await next cured lens group

THERMAL CURING OVEN AND THERMAL CURING PROCESS

FIELD OF THE INVENTION

This invention concerns an oven for curing articles. In particular, a thermal cure oven is provided that is compatible with an automated manufacturing process having a substantially continuous product flow.

BACKGROUND AND OBJECTS OF THE INVENTION

The manufacture of a product requiring multiple manufacturing steps has, in the past, been conveniently performed by batch manufacturing processes. In batch processing, each process step is completed for every member of a group before the group is transferred to the next station for further processing.

The manufacture of modern ophthalmic lenses provides an example in which batch methods, for the most part, are no longer the most efficient means of production. However, some steps in the production of ophthalmic lenses still may be most efficiently handled by batch manufacturing processes. For example, lenses that are coated often require curing to harden and fix the coating, and all of the coated lenses must go through the same curing process regardless of their particular prescription.

Furthermore, ophthalmic lenses are made of polymer materials the melting point of which may be close to the temperature at which the coatings are cured. Thus, the lenses may become relatively soft during the curing process making it desirable to keep the environment in which the lenses are cured free of particulate contaminates that may come into contact with and adhere to the soft surfaces of the lens. It is also desirable that the curing environment be maintained at a substantially uniform temperature throughout, so that the lenses are exposed to the required temperature for the required time necessary to effect the complete curing of the coating material.

Therefore, a need exists for processes and equipment for use in batch curing coated lenses. Additionally, a need exists for processes and equipment in which the curing is carried out free from particulates and in carried out at a substantially uniform temperature.

BRIEF DESCRIPTION OF THE DRAWINGS

FIG. 3 is a flow chart outlining manufacturing steps for curing a coating on ophthalmic lenses;

DETAILED DESCRIPTION OF THE PREFERRED EMBODIMENT

Figure 1:
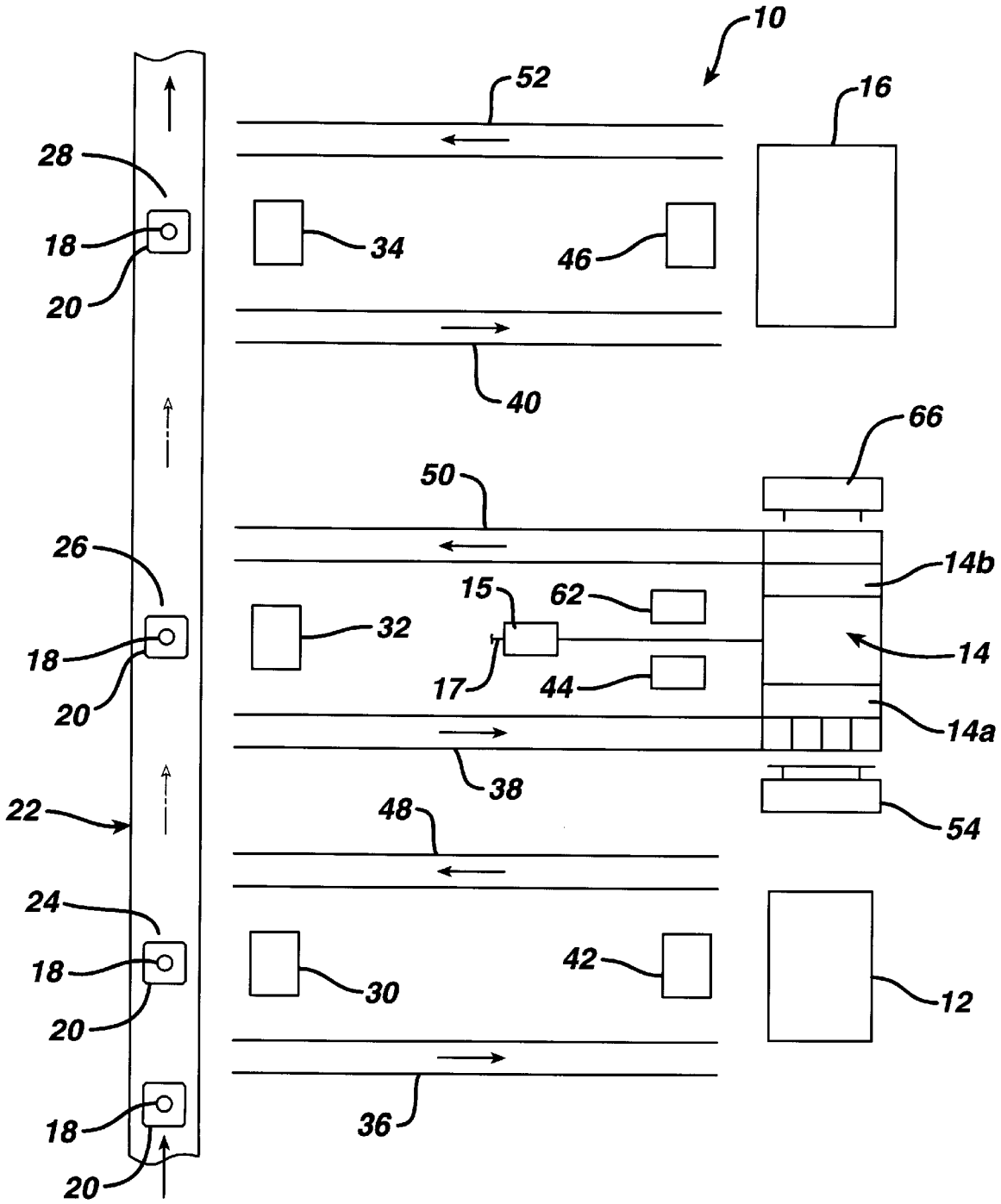
FIG. 1 is a schematic top plan view of a portion of a manufacturing line for ophthalmic lenses.

The invention provides an oven for heating a plurality of items in an atmosphere substantially free of particulate contaminants. The invention also provides a batch process for thermal curing ophthalmic lenses that is compatible with a substantially continuous manufacturing process for the lenses. Further, the temperature throughout the oven of the invention is substantially uniform to ensure adequate exposure of all the lenses in the oven.

The oven of the invention preferably comprises a plurality of side walls defining an enclosed oven chamber and a heating element for heating the air within the oven chamber. An intake blower is configured to receive air from the ambient and force the ambient air into the oven chamber, thereby maintaining the air pressure therein at a relatively higher pressure than the pressure of the ambient air. This prevents airborne particulate contaminants from being drawn into the oven chamber. An air filter, preferably a HEPA type, is operatively associated with the intake blower to filter the air forced into the oven chamber. The oven also has an exhaust blower configured to draw air from the oven chamber and exhaust the air to the ambient. The exhaust blower works in conjunction with the intake blower to provide air exchange with the ambient while maintaining the relatively higher pressure state within the oven chamber.

A temperature sensor allows the heating element to be controlled to maintain the air within the oven chamber at a desired temperature, for example, the temperature required to cure a coating on an ophthalmic lens. A closeable entrance is arranged in one of the side walls of the oven for admitting the items to be heated to the oven chamber. There is also a closeable exit arranged in one of the side walls for releasing the items from the oven chamber. A conveyor within the oven chamber carries the items to be heated through the oven. The items are movable on the conveyor throughout the oven chamber from a first position, adjacent to the entrance, to a second position, adjacent to the exit and through a plurality of intermediate positions therebetween. The conveyor is capable of carrying at least one but, preferably, carries a plurality of the items.

The various systems are under the command of a controller that controls the motion of the conveyor, the entrance and exit openings the first and second blowers and the heating element (with feedback from the temperature sensor) to coordinate the operation of the oven. In a preferred embodiment, the conveyor comprises a flexible mechanical element, such as a chain, housed within an elongated trough. The trough has a ventilation aperture in communication with the air in the oven chamber and is also in fluid communication with the exhaust blower such that the exhaust blower draws air from the oven chamber through the trough and exhausts the air to the ambient.

The air within the oven is constantly filtered and recirculated within the oven chamber primarily to limit the concentration and size of particulate contaminates to acceptable levels. Recirculation of the air also ensures thorough mixing, thus, providing for a more consistent temperature throughout the oven chamber, avoiding hot spots that may overheat and melt the items, as well as cooler zones insufficient to perform the task for which the oven is designed.

The invention also contemplates a process for manufacturing a multiplicity of items wherein the items are moved one item at a time substantially simultaneously through a plurality of respective work stations at which respective manufacturing steps are effected on each said item substantially simultaneously. The process includes at least one work station, such as the oven described above, through which a plurality of the items moves together as a group. Preferably, the process comprises, consists essentially of and consists of the steps of:

(a) moving a plurality of items to the one work station one item at a time;

(b) accumulating the plurality of items at the one work station to form a group comprising the plurality of items;

(c) admitting the group to the one work station;

(d) performing a manufacturing step, such as heating or curing, on the items comprising the group at the one work station;

(e) discharging the group from the one work station;

(f) moving the plurality of items comprising the group one item at a time to another of the stations.

Preferably, the process comprises, consists essentially of and consists of moving a plurality of groups through the one work station substantially simultaneously, one group of the plurality being discharged from the one work station as another group of the plurality is admitted to the one work station. This allows the process to operate in a combination of a batch mode and a quasi-continuous mode and thus be compatible with other processes, upstream and downstream of the one work station where the product moves through the other stations in a substantially continuous flow.

The method of the invention may be applied to the task of heating pluralities of items while maintaining a surface of the items substantially contaminant free. This process is particularly suited to curing a coating on ophthalmic lenses and allows the curing step to be efficiently accomplished in a batch mode while integrating the task into a manufacturing process which proceeds with a substantially continuous product flow. Preferably, the applied method comprises, consists essentially of and consists of the steps of:

(a) providing an oven having an oven chamber adapted to receive the pluralities of the items, such as the ophthalmic lenses, the oven chamber having a closeable entrance and a closeable exit;

(b) providing a conveyor located within the oven chamber and adapted to transport the pluralities of items from a first position adjacent to the entrance, to a second position adjacent to the exit, and through an intermediate position between the entrance and the exit within the oven chamber;

(c) heating the air within the oven chamber;

(d) forcing ambient air into the oven chamber under pressure at a first rate;

(e) filtering the ambient air forced into the oven chamber;

(f) exhausting air from the oven chamber at a second rate lower than the first rate, thereby maintaining the air pressure within the oven chamber at a relatively higher pressure than the ambient air;

(g) opening the entrance;

(h) placing a first plurality of the items onto the conveyor at the first position;

(i) closing the entrance;

(j) transporting the first plurality to the intermediate position on the conveyor;

(k) repeating steps (g) through (j) for a second plurality of the items;

(l) transporting the first plurality of items to the second position and the second plurality of items to the intermediate position;

(m) repeating steps (g) through (j) for a third plurality of the items;

(n) opening the exit;

(o) removing the first plurality of items from the oven chamber;

(p) closing the exit; and steps (c) through (f) being performed simultaneously with one another and with steps (g) through (p). The steps (i) and (l) are performed in a stepwise manner between the positions allowing the conveyor to dwell at the entrance and exits to accept and discharge the pluralities of items to and from the oven chamber.

FIG. 1 shows a plan schematic view of a portion of a manufacturing line 10 for ophthalmic lenses having a plurality of work stations 12, 14 and 16 at which different manufacturing steps are performed on each lens. Each lens 18 may be held in its own carrier 20, the carriers being transported by a main conveyor 22 to predetermined transfer locations such as 24, 26 and 28 along main conveyor 22 where transfer means, such as robotic transfer devices, 30, 32 and 34 can pick carriers off of the main conveyor and place them on adjacent secondary conveyors such as 36, 38 and 40.

The secondary conveyors transport the carriers 20 with their lens 18 to other robotic transfer devices, indicated at 42, 54 and 46. The other robotic transfer devices (42, 54 and 46) transfer the lens 18 from the adjacent secondary conveyors to a respective work station (12, 14, 16 as appropriate) where a particular manufacturing step is performed on each lens. Manufacturing steps may include, without limitation, grinding, casting, edging, cleaning, inspecting, coating, curing, packaging, and the like and combinations thereof.

Upon completion of the manufacturing step at a particular work station, the other robotic transfer devices (42, 46 and 66) move the lenses 18 in their carriers 20 from the work station to associated return conveyors indicated at 48, 50 and 52. The return conveyors transport the lens on their carriers back to main conveyor 22 where the aforementioned robotic transfer devices (30, 32 and 34) transfer the lens and carriers back onto the main conveyor where each lens is transported to the next work station for further processing.

The conveyors are of conventional design and are preferably endless belts with palates or plates on their upper surface for receiving the carriers 20. The robotic transfer devices may be, for example, four finger grippers on articulated arms, suction devices, push rams, lifting forks, pick and place mechanisms and the like as appropriate to move the lenses between the various conveyors and work stations.

The entire manufacturing line preferably is under the control of a manufacturing execution system ("MES") that connects a computerized lens ordering system to the manufacturing equipment. Each lens is identified to the system by a unique bar code displayed on its carrier 20. The bar codes are read by scanners (not shown) positioned at various locations on the manufacturing line allowing the MES to identify, track and process each lens as an individual product that may require different manufacturing steps to be performed at the various work stations. A preferred manufacturing line, including the MES, are described in related co-pending application Ser. No. 09/579,048 entitled "Process for the Automated Manufacture of Spectacle Lenses" (Attorney docket number INT 89) incorporated in its entirety by reference.

Preferably, the lenses move through the line in a continuous flow, each manufacturing step, including transporting the lenses to and from a particular work station, taking no longer than a brief period of time, for example, about 5 to about 15 seconds. Thus, a lens arrives at a particular work station for processing, seconds later the process is complete, the lens is sent on its way to the next station and another lens arrives for processing.

Although most of the manufacturing steps for ophthamic lenses can be performed within a short period of time, some operations such as lens coating curing, which cannot. Ophthalmic lenses desirably may be coated with coatings, including, without limitation, anti-reflective coatings, scratch resistant coatings, photochromic coatings, polarizing coatings, or combinations thereof. The coatings must be hardened by a curing step including, without limitation, radiation, thermal, visible light curing and combinations thereof.

Modern ophthalmic lenses are made of polymer materials that tend to be relatively soft and, therefore, easily scratched. It is, thus, desirable to coat these lenses with a scratch-resistant coating to protect the outer surface. The scratch-resistant coating requires that the lenses be subjected to temperatures of about 115 to about 130° C. for a duration of about 2½ to 3½ hours to completely cure the coating.

Incorporation of the curing step into an automated lens manufacturing process is efficiently accomplished by using the oven of the invention, shown at 14 in FIG. 1. The lenses are organized into groups that enter and leave the oven in a quasi-continuous, first in first out (FIFO) process preferably timed to be compatible with the operation of the other work stations on the manufacturing line.

By way of example, the work stations shown in FIG. 1 represent: (a) a lens inspection station 12 where the lenses are optically and cosmetically examined after receiving a scratch resistant coating at an upstream station; (b) the thermal curing oven 14 where the lenses are subjected to the appropriate temperature conditions for the appropriate duration to completely cure the coating; and (c) a lens finishing station 16 where the lenses, once cured, undergo further optical inspection, marking, edging and packaging.

Figure 2:
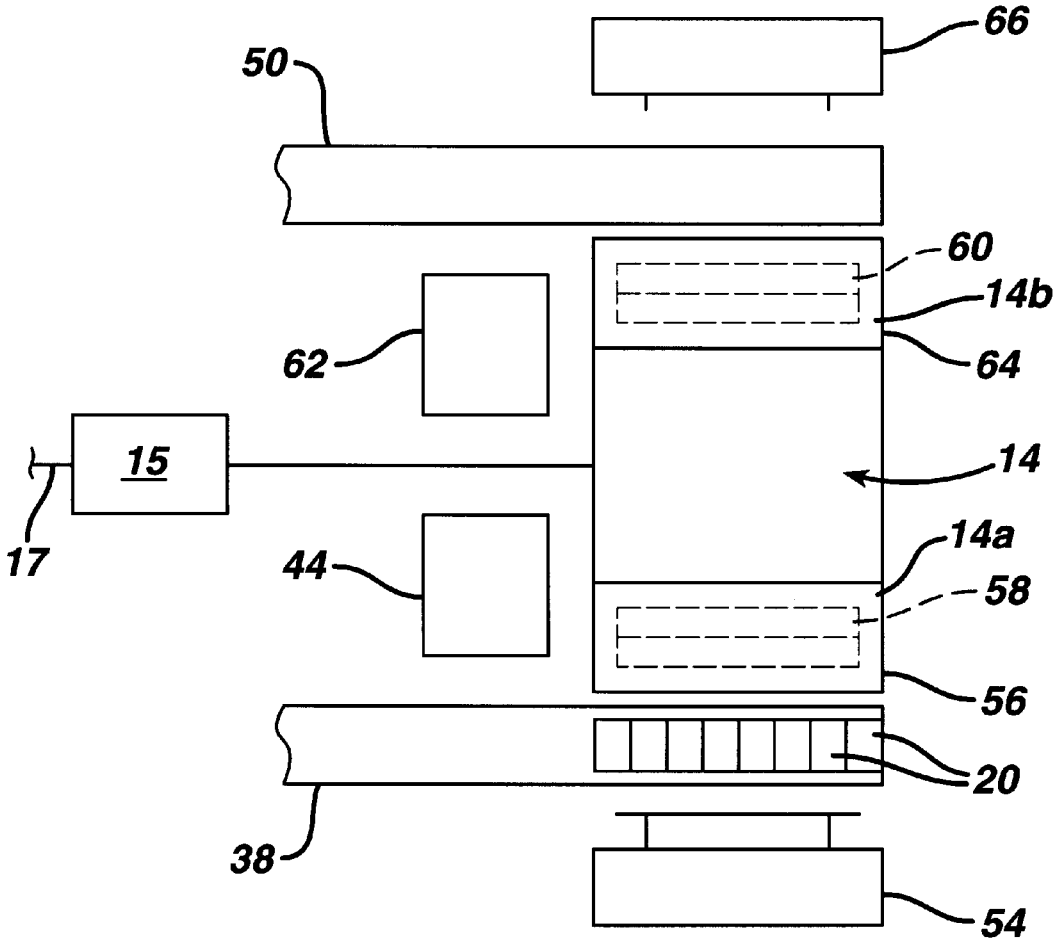
FIG. 2 shows a detailed portion of FIG. 1 on an enlarged scale.

In operation, a lens 18 on its carrier 20 arrives every several seconds at transfer location 26 along main conveyor 22. By the time the lenses reach transfer location 26, each has been ground and/or cast to a particular optical prescription, cosmetically and optically inspected and coated with a scratch resistant coating that must be cured. The robotic transfer device 32, preferably a four-finger gripper type, transfers the carrier 20 with its lens 18 onto secondary conveyor 38 that transports the carrier to the oven 14. Preferably, secondary conveyor 38 is a "dead end" conveyor allowing a plurality of carriers 20 to line up adjacent to the "load side" 14*a* of the oven 14, as shown in FIG. 2.

After a desired number of carriers 20 accumulates on conveyor 38, another robotic transfer device, preferably a push ram 54, moves the accumulated carriers onto a load side transfer plate 56 arranged adjacent to an entrance opening to the oven 14, described below. In the preferred embodiment, the carriers are staged onto the load side transfer plate in groups of 24 carriers and lenses arranged in two adjacent rows of 12. One such group, 58, is shown in FIG. 2. Thus, for example, over a period of 240 seconds, 24 carriers are transferred one at a time to secondary conveyor 38, transported on the conveyor to a position adjacent to oven 14 and moved in two rows of 12 onto load side transfer plate 56 forming a group 58.

Once the group 58 is staged on the transfer plate, the oven entrance is opened and another robotic transfer device, 44, moves the group into oven 14, placing the carriers onto a conveyor within the oven (described below). As the group 58 is transferred into the oven another group 60, which entered the oven about three hours earlier, is discharged from the opposite or "unload side" of the oven 14*b*. The curing process being completed for the lenses in group 60, a robotic transfer device 62 removes the group 60 from the oven and places it on an unload side transfer plate 64. Each row of 12 carriers from the group 60 is moved onto return conveyor 50 by another robotic transfer device 66, and the carriers are transported back to transfer location 26 of the main conveyor 22 (see FIG. 1) where the robotic transfer device 32 transfers the carriers 20 with their lenses 18 to the main conveyor 22 one at the desired interval. The main conveyor transports each carrier in turn to the lens finishing station 16 at which the cured lenses may undergo further optical inspection, marking, edging and packaging, and the like and combinations thereof.

The oven operates effectively as a component of the manufacturing line such that it appears to both its neighboring upstream and downstream work stations to process lenses one at a time in several second intervals when in actuality there are three hours worth of lenses being processed at any one time in the oven in a FIFO batch operation. It is understood that production parameters such as the processing interval per lens, the number of lenses in a group, and the duration of the curing time when specified herein are by way of example of a preferred embodiment only and will vary depending upon the particular needs of the particular product being manufactured.

Figure 6:
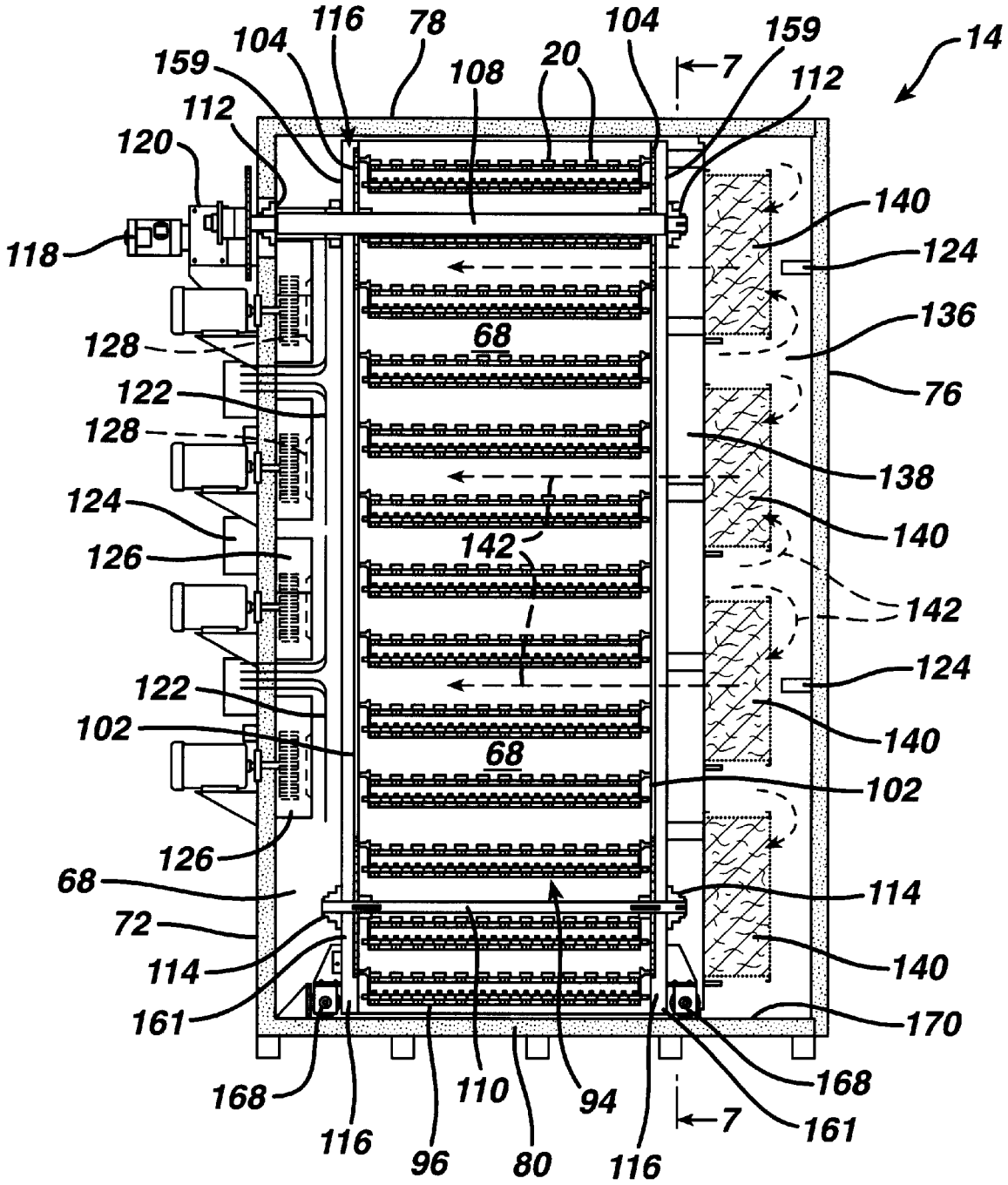
FIG. 6 is a cross-sectional view of the oven taken along section line 6—6 of FIG. 4.
Figure 7:
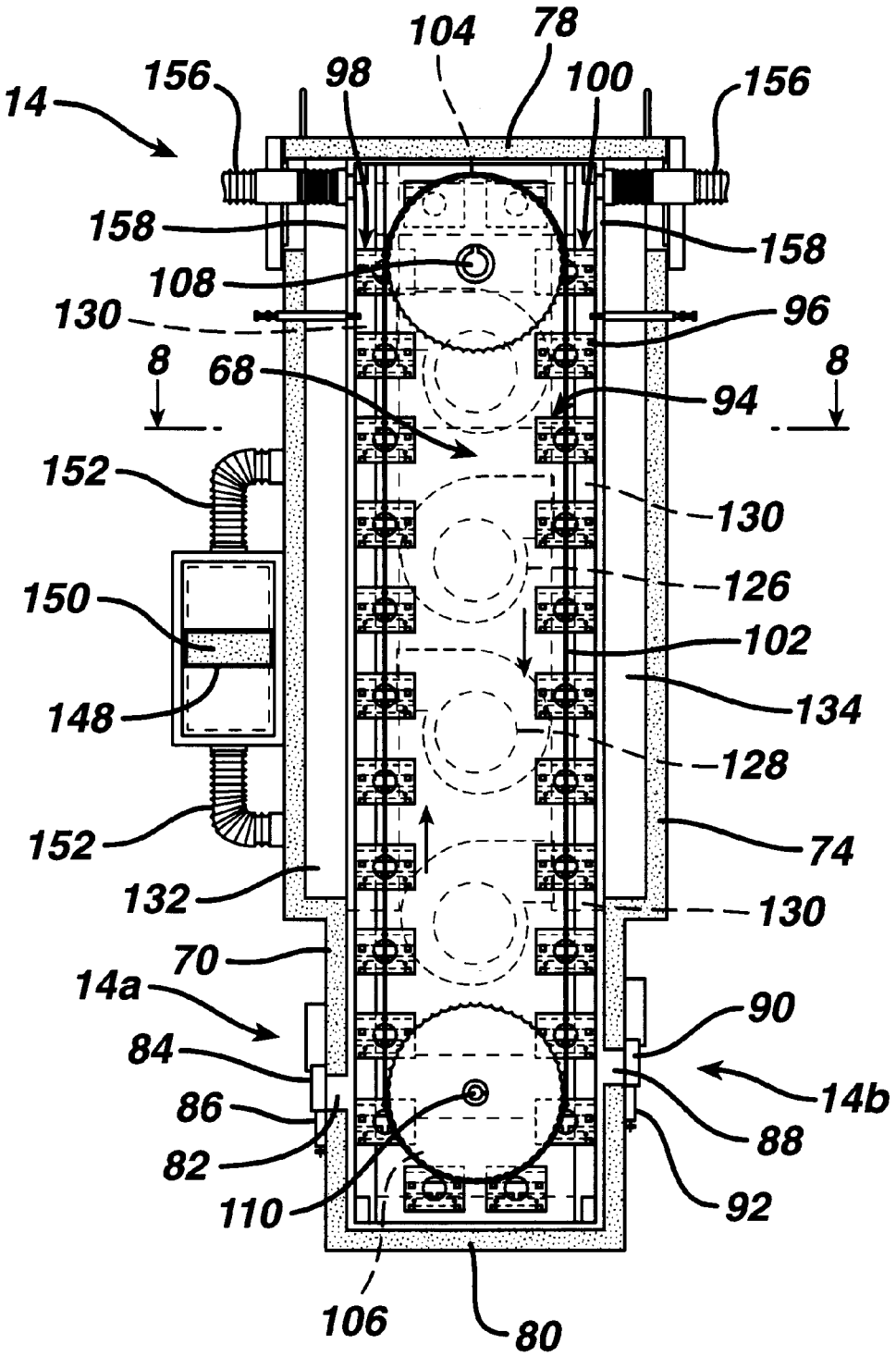
FIG. 7 is a cross-sectional view of the oven taken along section line 7—7 of FIG. 6.
Figure 8:
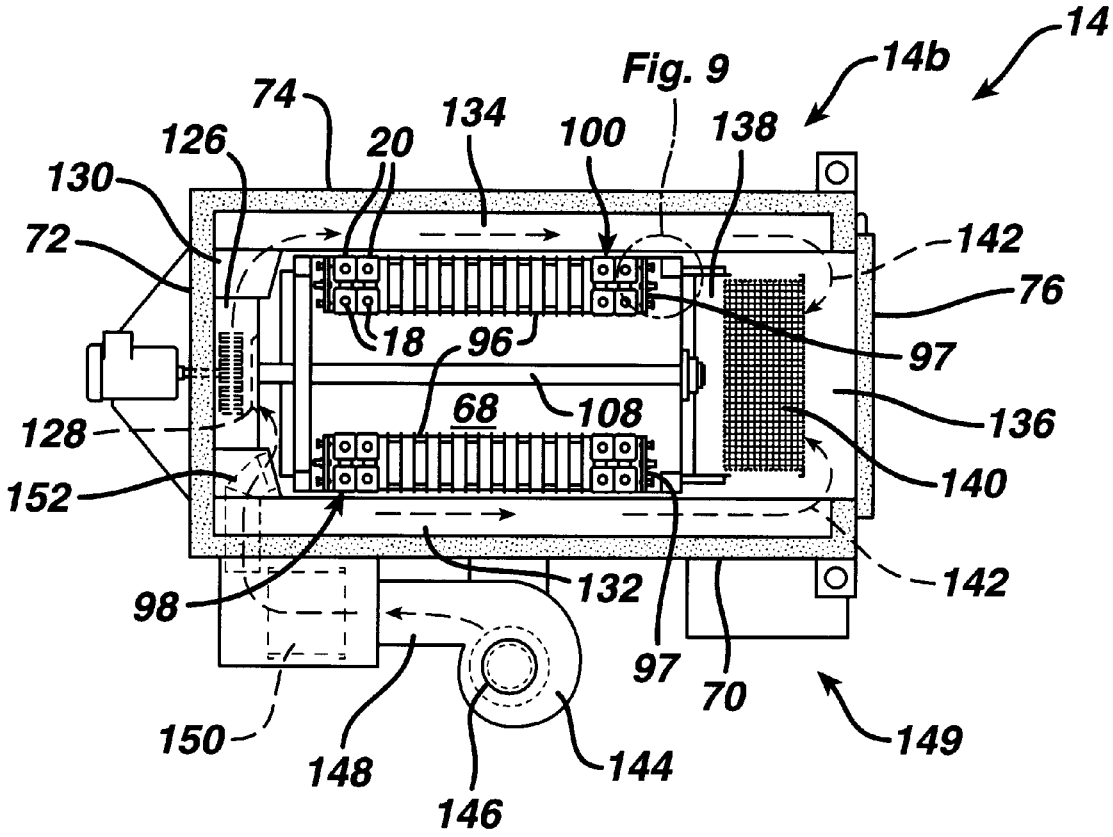
FIG. 8 is a cross-sectional view of the oven taken along section line 8—8 in FIG. 7.

As best shown in FIGS. 6–8, curing oven 14 comprises, consists essentially of, and consists of an enclosed chamber 68 surrounded by a plurality of insulated side walls 70, 72, 74, 76 and top and bottom closure panels 78 and 80 respectively. As seen in FIG. 7, sidewall 70 is positioned on the load side 14*a* of the oven and has an opening 82 which is closeable by a door 84. Door 84 is opened and closed by means of actuators 86 to admit lens groups such as 58 to the oven chamber for curing. A similar opening 88 and door 90 are positioned on the unload side sidewall 74, door 90 being opened and closed by means of its own actuators 92 to discharge lens groups from the oven chamber 68. The operation of the doors 84 and 90 is controlled by a local microprocessor 15 (see FIG. 1) under command of the MES (not shown) through a connecting cable 17, the microprocessor 15 coordinating the operation of the oven, the conveyors and the robotic transfer devices to ensure an orderly flow of product through the oven. A suitable microprocessor is an Allen Bradley SLC-505 PLC along with an Allen Bradley Panelview 1000.

A conveyor 94, that holds and transports the lenses, is positioned within the oven chamber 68, as shown in FIGS. 6 and 7. Preferably, conveyor 94 is a vertically oriented carousel which has a plurality of carrier bars 96 positioned substantially one above another in two adjacent runs, an upward run 98 facing the load side sidewall 70 of the oven and a downward run 100 facing the unload side sidewall 74.

Figure 11:
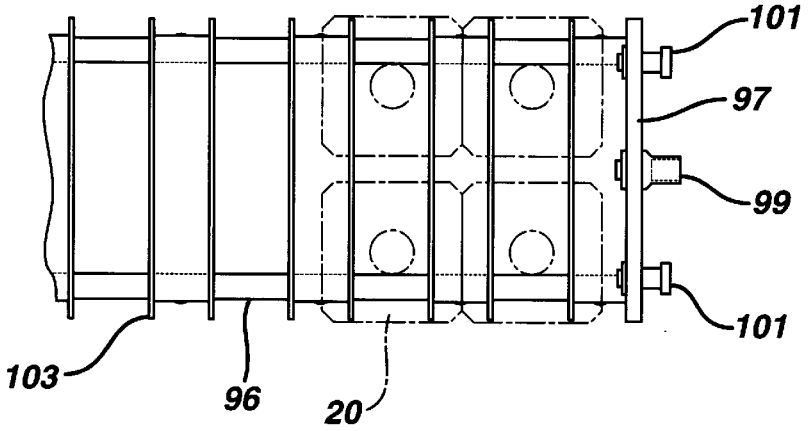
FIG. 11 is a partial top plan view of a carrier bar assembly with lens carriers shown in phantom line.
Figure 12:
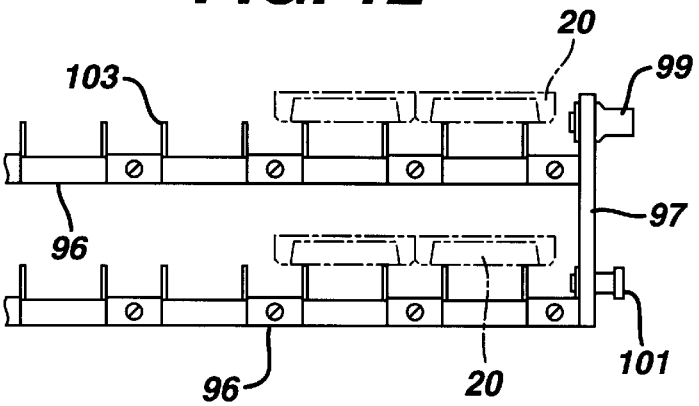
FIG. 12 is a front elevational view of the carrier bar assembly shown in FIG. 10.
Figure 13:
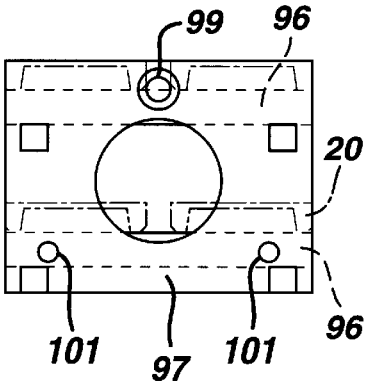
FIG. 13 is an end elevational view of the carrier bar assembly of FIG. 12.

Carrier bars 96, shown in FIG. 8 and in detail in FIGS. 11–13, are adapted to support carriers 20 in groups of 24 to transport the lenses 18 through the oven chamber 68. Preferably, two carrier bars 96 are mounted on pairs of end plates 97 which have protrusions 99 and 101 to effect mounting of the carrier bars to the conveyor, as described below. A plurality of standoffs 103 are arranged in spaced relation lengthwise along the carrier bars. Standoffs 103 are spaced so as to support lens carriers 20 and allow them to be placed on and removed from each carrier bar in groups of 24 by means of a robotic transfer device, such as 44 and 62, the transfer device having lifting tines which support the carriers 20 and interfit between the standoffs 103 to effect the transfer to the carrier bars without disturbing lenses 18.

The carrier bars are suspended on one or more flexible mechanical elements which support and convey the carrier bars through the oven chamber 68. As used herein, flexible mechanical elements refers to items such as belts, ropes, chains and cables that can be formed into an endless loop that can support and move the items in the manner of a conveyor.

Figure 9:
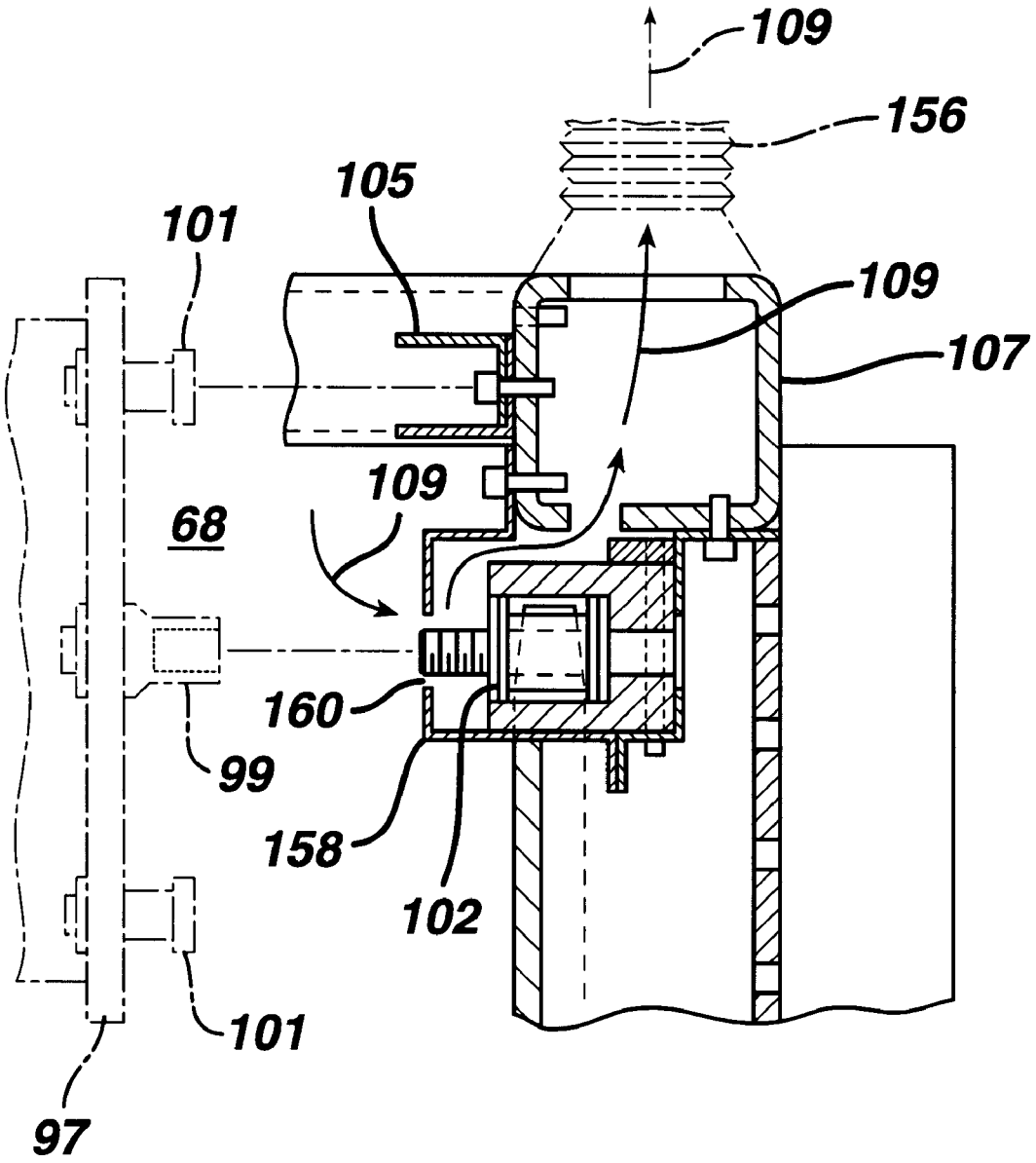
FIG. 9 is an enlarged fragmentary cross-sectional view of a portion of the oven shown encircled in FIG. 8.

In the preferred embodiment, the flexible mechanical elements are a pair of oppositely arranged endless chains 102. As best shown in FIG. 9, the carrier bars 96 are rotatably mounted on the chains 102 by means of protrusions 99 rotatably engaging chains 102 (only one mounting being shown) allowing the carrier bars to remain level at all times during their motion through the oven chamber. The carrier bars are also stabilized so as not to rotate when carriers are being loaded onto them. The stabilization is provided by means of protrusions 101 engaging an elongated "U" channel 105 which is attached to the side frame member 107, channel 105 extending substantially vertically lengthwise along the conveyor runs and preventing excessive rotation of the carrier bars when they are loaded and unloaded with carriers. A separate channel 105 is provided for each run of the conveyor, one of the two protrusions 101 engaging the channel as appropriate depending upon which run (upward, 98, or downward, 100) the particular carrier bar is traversing.

As shown in FIGS. 6 and 7, endless chains 102 engage two pairs of toothed sprockets, a top pair 104 and a bottom pair 106. The sprocket pairs are connected by respective top and bottom axles 108 and 1 10 which are rotatably supported on respective top and bottom bearing pairs 112 and 114. The bearing pairs are supported on a support framework 116 which is removably positioned within oven chamber 68 as described in detail below. Preferably, the bottom axle/sprocket pair is an idler while the top axle/sprocket is driven by an electric motor 118. Motor 118 is coupled to the top axle through a reduction gear transmission 120. Motor 118 is controlled by the local microprocessor 15 and moves the conveyor 94 in a stepwise fashion through the oven chamber, as described below.

FIG. 6 shows a plurality of heating elements 122 positioned within the oven chamber 68 to heat the air within the oven and maintain the temperature at the desired level to effect curing of the coating. The heating elements are preferably of the electrical resistive variety and have a capacity of about 48,000 watts. Their operation is controlled by the local microprocessor with the help of temperature sensors 124 positioned within the oven chamber. The sensors feed back temperature information to the local microprocessor 15 which activates the heating elements 122 as necessary to keep the air in the oven chamber within the desired limits. For curing a scratch resistant coating, for example, the oven temperature preferably is kept between about 115 to about 130° C.

The relatively high curing temperature means that the lenses may be somewhat soft as they proceed through the oven and if particulate contaminants within the oven contact the lens surface, they will adhere and become embedded in the soft lens surface. Thus, it is important that the size and concentration of particulate contaminants within the oven chamber be held to acceptable levels that will not adversely affect the lenses.

To control the size and concentration of particulate contaminants within the oven chamber, four steps are taken: (1) all components located within the oven are made of stainless steel or anodized aluminum; (2) air within the oven chamber 68 is constantly recirculated and filtered; (3) the air pressure within the oven chamber is kept at a pressure higher than the ambient; and (4) the moving parts such as the sprockets and endless chains are fully enclosed, and this enclosure is separately exhausted to create negative pressure with respect to the oven environment.

Using stainless steel or anodized aluminum for components located within the oven will help prevent particulate contaminants within the oven, because these metals will not oxidize and release oxidation particles, such as rust flecks, into the oven chamber. Recirculating the air within the chamber ensures mixing of the air and results in a more consistent temperature distribution throughout the oven chamber, preventing hot or cold spots from forming. Constant filtering of the air during its recirculation removes any particulate contaminates from the air and prevents them from contaminating the lenses.

Air within the oven chamber is recirculated by means of recirculation blowers 126, illustrated in FIG. 6. Preferably, the recirculation blowers are mounted in a side wall such as the side wall 72 which is not the load or unload side of oven 14. As shown in FIGS. 7 and 8, recirculation blowers 126 have intakes 128 positioned within the oven chamber 68 allowing the blowers to draw air through the chamber across the carrier bars 96 of conveyor 94. Blowers 126 have outlets 130 which direct the air through a pair of supply ducts 132 and 134 arranged on the load and unload sides of the oven respectively, supply duct 132 being positioned between load side sidewall 70 and the oven chamber 68 and supply duct 134 being positioned between unload side sidewall and the oven chamber.

Supply ducts 132 and 134 direct the air to a plenum 136 located on the side of the oven opposite the blowers between side wall 76 and oven chamber 68. As shown in FIGS. 6 and 8, oven chamber 68 has a plurality of openings 138 providing fluid communication with plenum 136, each opening having a recirculation filter 140 which filters the recirculating air as it passes from the plenum 136 to the oven chamber 68. Recirculation filters 140 are preferably HEPA filters and can filter out particles as small as about 0.3 microns in size. The recirculation air flow regime within the oven is shown by arrows 142. Air is drawn through oven chamber 68 by recirculation blowers 126 and forced through supply ducts 132 and 134 on opposite sides of the oven chamber. The supply ducts direct the air into plenum 136, and the air passes through recirculation filters 140 where particulate contaminants are separated from the flow before again entering oven chamber 68. Heating elements 122 are located adjacent to the recirculation blowers 126 heating the air as required to maintain the desired curing temperature within the oven and temperature sensors 124 are preferably located adjacent to where the recirculating air enters the oven chamber. The recirculation air is permitted to mix in the supply ducts 132 and 134 as well as the plenum 136 to help ensure a consistent temperature throughout the oven chamber 68.

Keeping the air pressure within the oven chamber higher than the ambient air pressure prevents particles in the ambient air from entering the oven, as, for example, when doors 84 and 90 are opened to respectively load and discharge lenses. Air pressure within the oven chamber is primarily controlled by an intake blower 144 shown in FIG. 5, which forces ambient air into the oven chamber 68 at a greater rate than it is permitted to escape. Intake blower 144 is preferably mounted on the load side 14*a* ofthe oven 14 and has an inlet 146 which draws air from the ambient, and an outlet 148 which directs the air to an intake air filter 150 which separates particulate contaminants from the ambient air. Preferably, intake air filter 150 is a HEPA type filter which will filter particles down to 0.3 microns in size from the ambient air.

After filtering, the air drawn from the ambient is directed through one or more inlet ducts 152 into the oven chamber 68. Preferably, as seen in FIG. 8, inlet ducts 152 are positioned adjacent to one or more intakes 128 of the recirculation blowers 126. Thus, ambient air forced into the oven chamber by the intake blower 144 will not immediately contact any of the lenses within the oven chamber but will first be drawn into the recirculation blowers, forced through the supply ducts 132 and 134, into plenum 136 and through filters 140 before it is allowed to contact the lenses on conveyor 94. Routing the air drawn in from the ambient in this manner ensures that it will pass through two sets of filters, the intake air filter 150 and the recirculation filters 140, before it contacts any lenses, thus, helping to prevent contamination of the oven chamber with particulates from the ambient.

Figure 4:
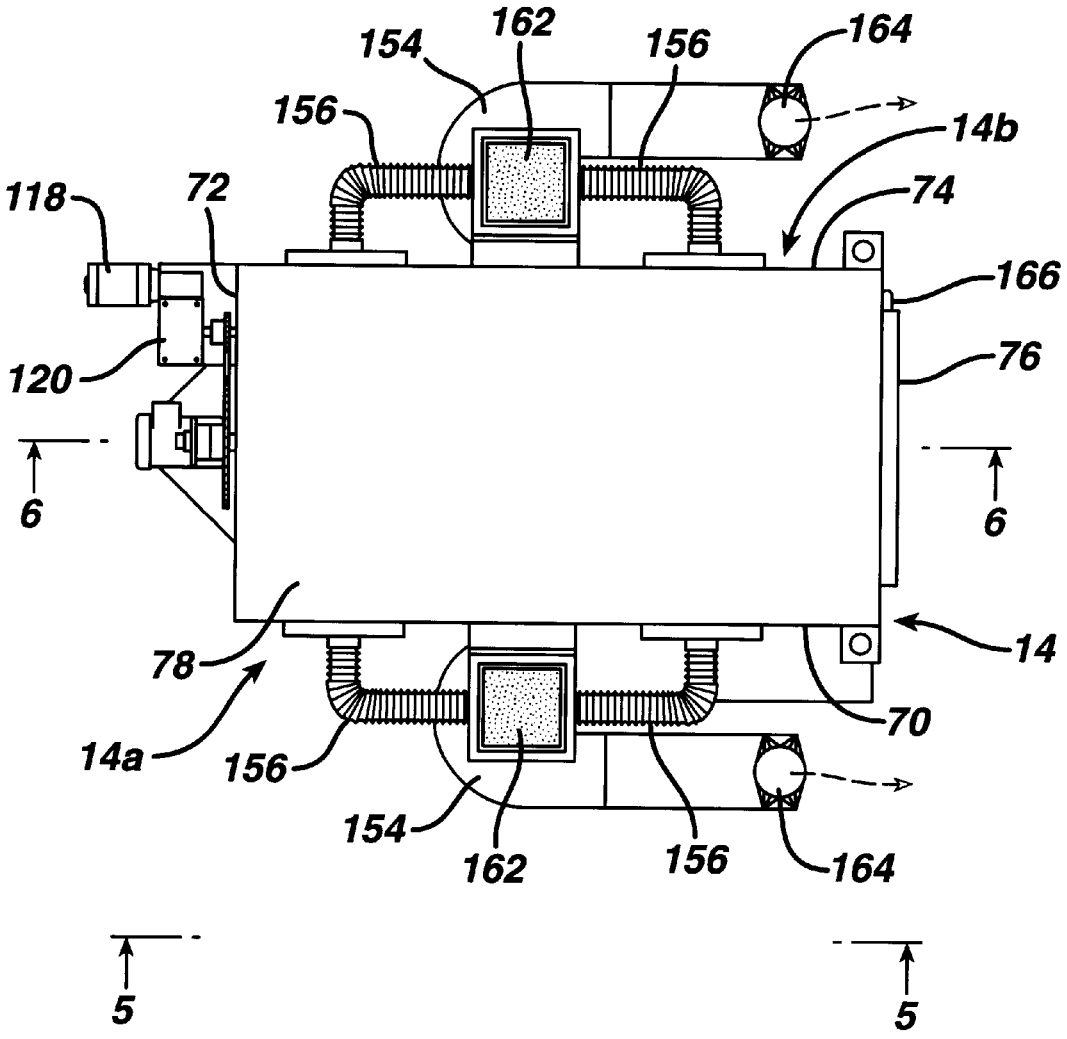
FIG. 4 is a top plan view of a thermal curing oven according to the invention.
Figure 5:
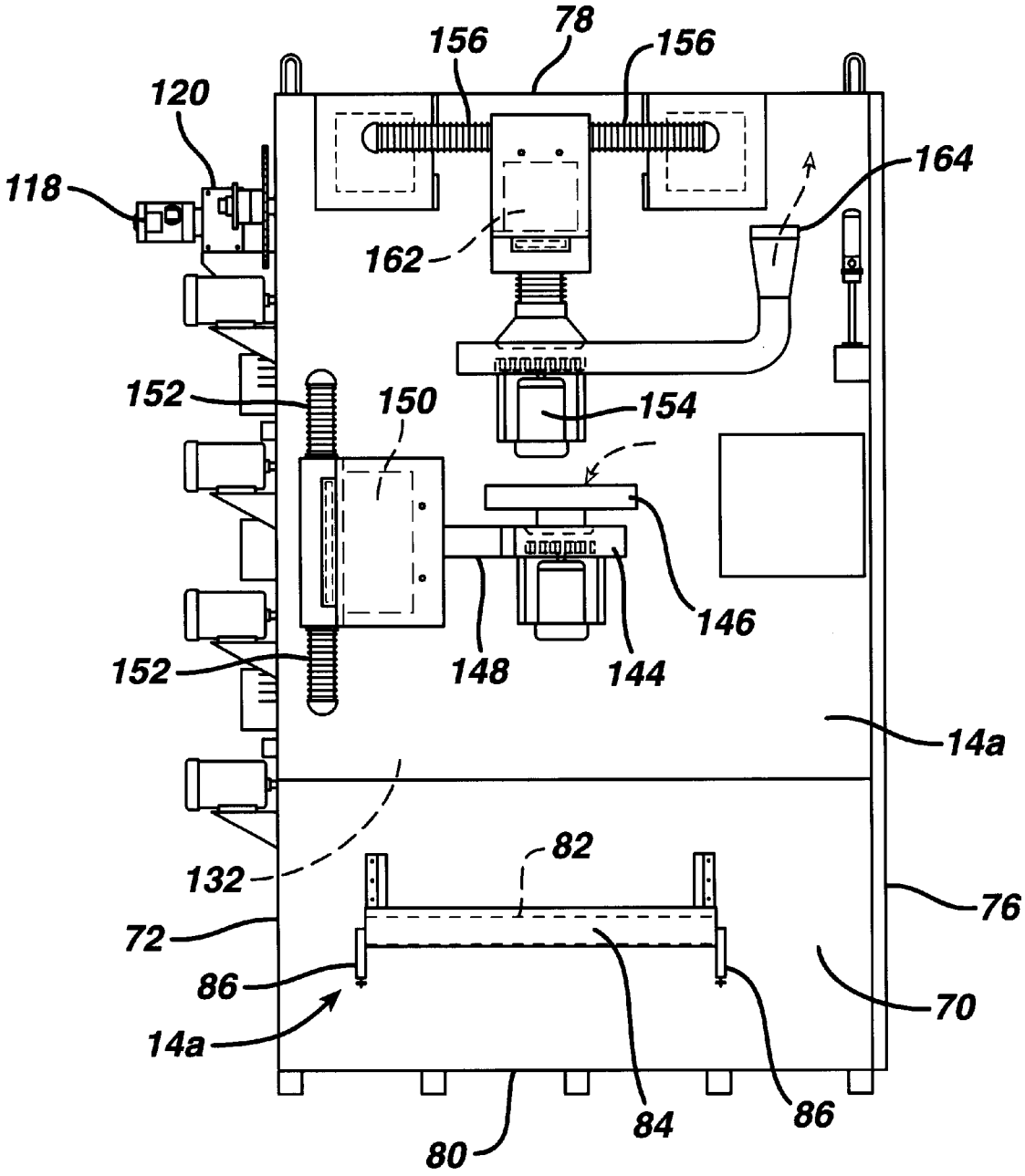
FIG. 5 is a side elevational view of the oven as seen along view line 5—5 of FIG. 4.

It is desirable to draw air out of the oven at a controlled rate to control the exchange of air between the oven chamber and the ambient, as well as to control the pressure differential between the oven chamber and the ambient. As shown in FIGS. 4 and 5, air is drawn from the oven chamber preferably by a pair of exhaust blowers 154 located on opposite sides of the oven, preferably on the load and unload sides 14*a* and 14*b*. As best shown in FIGS. 7 and 9, exhaust blowers 154 each have a pair of inlet ducts 156, which are in fluid communication with, respectively, a pair of troughs 158 arranged on opposite sides of conveyor 94. A detail of the air flow from oven chamber 68 to the inlet duct 156 is shown in detail in FIG. 9, the air flow being shown by arrows 109.

Figure 10:
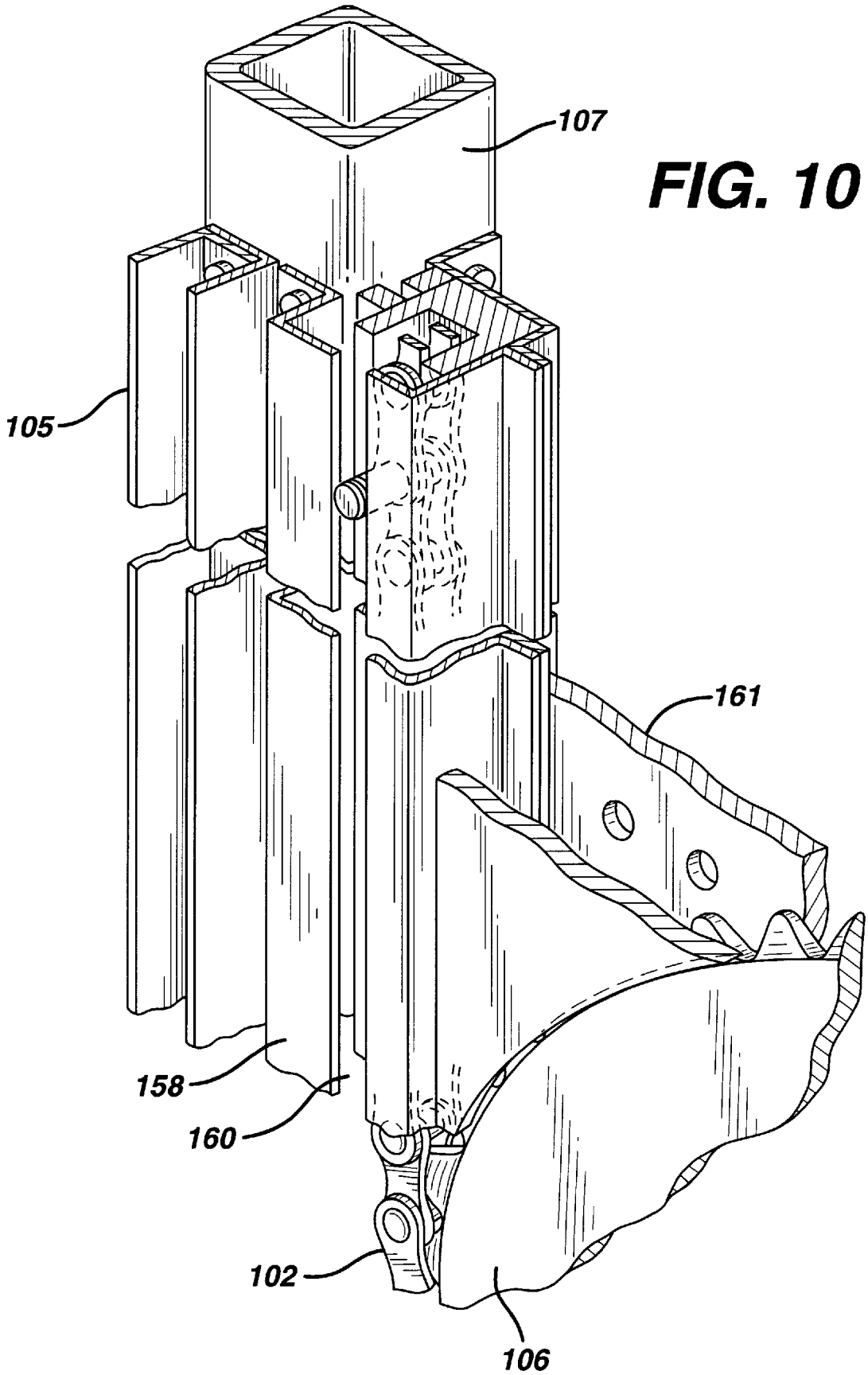
FIG. 10 is a fragmentary cross-sectional perspective view of a portion of the oven.

Troughs 158 extend substantially the length of the oven chamber between pairs of top and bottom shrouds 159 and 161 which enclose the top and bottom sprockets respectively, as shown in detail in FIG. 10 for one sprocket 106. As shown in FIGS. 9 and 10, endless chains 102 travel within troughs 158 between the sprockets, and the troughs and shrouds serve to enclose these moving parts and contain any particulate contaminates generated by them. Troughs 158 have openings 160 which allow air to be drawn from the oven chamber, the troughs and shrouds being kept under negative pressure by the operation of exhaust blowers 154. Air from the oven chamber, as well as any contaminants from the chains and sprockets, are conducted through the troughs to the inlet ducts 156 of the exhaust blowers 154 (see FIGS. 7 and 9) where the air and contaminants exit the oven and enter an exhaust air filter 162 (see FIGS. 4 and 5). By substantially containing the chains and sprockets within the troughs and shrouds and drawing, he air from the oven chamber through the troughs particulates from the chains and sprockets are substantially prevented from entering the oven chamber 68.

Exhaust air filter 162 is preferably a HEPA filter which separates particles down to about 0.3 microns in size from the exhaust air. After filtering, the exhaust air exits into the ambient through an outlet 164. It is desirable to filter the air exhausted from the oven so as not to contaminate the area around the oven with particulates from the oven. This helps avoid contamination of lenses which are staged on the conveyors 38 and 50 and on the transfer plates 56 and 64, as well as on the main conveyor 22.

Exhaust blowers 154 work in conjunction with intake blower 144 not only to ensure that air pressure within the oven chamber 68 is higher than the ambient, but also to ensure that there is an adequate exchange of air between the oven and the ambient. Air exchange is desired to prevent the build-up of gaseous contaminates which result from the curing process and outgassing from the lenses. In the illustrated embodiment, the volume of the oven is 180 cubic feet, and the air is completely changed from this volume about 150 to about 210 times per hour. Air flow velocity into the oven through the intake air filter is preferably between about 60 and about 90 feet per minute.

Together, the recirculation blowers 126, recirculation filters 140, intake blower 144, intake air filter 150 and exhaust blowers 154 operate to keep the level of airborne particulates within the oven chamber to: (1) fewer than about 1000 particles of about 0.5 microns or larger per cubic foot of air; or (2) fewer than about 7 particles of about 5 microns or larger, per cubic foot of air. This level of particulate control is equal to a class 1000 clean room.

Figure 14:
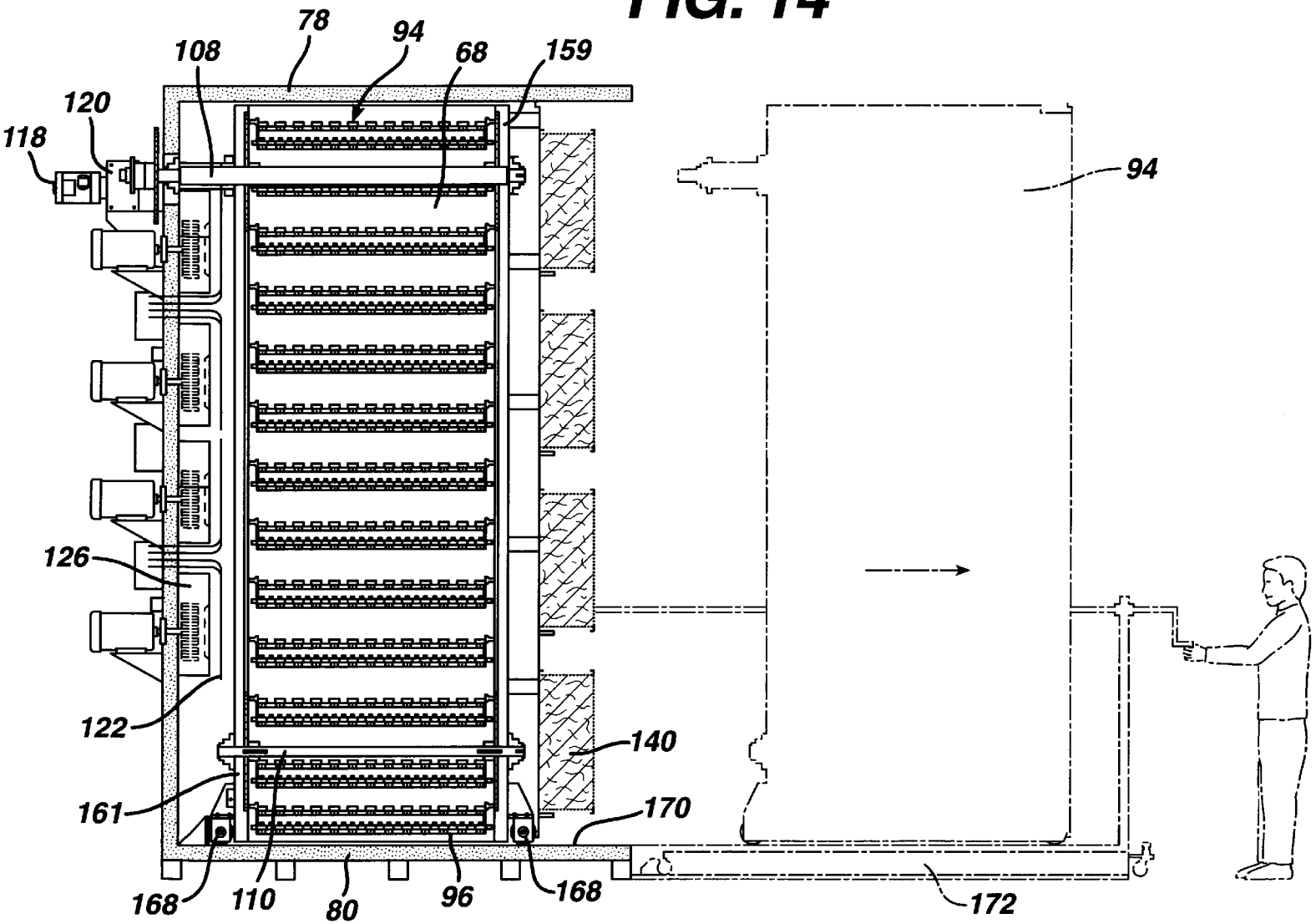
FIG. 14 is a cross-sectional side view showing the conveyor assembly in phantom line being removed from the oven.

To allow easy access to the various components of the oven for servicing and maintenance, conveyor 94 is designed to be easily removable from the oven chamber 68. As shown in FIG. 4, side wall 76 is attached to side wall 74 by means of hinges 166 allowing side wall 76 to form an access door which can be opened to remove the conveyor 94. Before removing the conveyor top, axle 108 is disconnected from the transmission 120 and exhaust blower inlet ducts 156 are detached from side frame members 107. As shown in FIG. 14, conveyor 94 is fitted with wheels 168 which run on tracks 170 in the bottom closure panel 80 of the oven. The wheels provide mobility and allow the conveyor 94 (shown in phantom line) to be rolled out of the oven chamber once it has been disconnected as described above. Preferably, upon removal from the conveyor chamber the conveyor is placed on a dolly 172 upon which it can be further transported. With the conveyor removed from the oven, technicians can work on both the conveyor and the oven in relative comfort and safety with all components being readily accessible.

The oven operates m cooperation with the main conveyor 22, the various robotic transfer devices, secondary conveyor 38 and return conveyor 50 under the control of the local microprocessor, which, in turn, is under the control of the MES. Referring to FIGS. 1 and 2 and to the flow chart shown in FIG. 3, a carrier 20 holding a lens 18 is transported along main conveyor 22 from upstream work station 12 to transfer location 26 where robotic transfer device 32 transfers the carrier 20 to secondary conveyor 38. Conveyor 38 moves the carrier 20 to a position adjacent to load side transfer plate 56 (FIG. 2). These steps are repeated preferably until 24 carriers 20 and lenses are staged on conveyor 38.

The carriers 20 are staged in two sub-groups numbering 12 carriers each. Robotic transfer device 54, preferably a push ram device, pushes 12 carriers from conveyor 38 onto load side transfer plate 56 and then remaining 12 carriers. Thus, a group 58 of 24 carriers is formed on the load side transfer plate, as seen in FIG. 2.

While carriers are being staged on the load side transfer plate, the oven conveyor 94 has moved its carrier bars 96 through one stepwise increment of its motion. The stepwise motion of the oven conveyor brings an empty carrier bar adjacent to load side opening 82 and a carrier bar, fully loaded with a group 60 of 24, carriers and lenses adjacent to unload side opening 88. The lenses of group 60 have been within the oven for the requisite time to allow the coating on the lenses to cure completely. For example, for a cure time of three hours, if the carrier bars are to move one increment every 240 seconds, there must be at least 45 increments along the conveyor between the load side and the unload side openings where each carrier bar dwells for 240 seconds between loading of a new group and unloading of a cured group, i.e., each group of lenses within the oven dwells at each of 45 increments for 240 seconds for a total of 45×240=10,800 seconds (three hours).

Door 84 on the load side is opened by its actuators 86 (FIG. 7), and robotic transfer device 44 (FIG. 2), preferably a lifting fork, picks up all 24 carriers of group 58 from the load side transfer plate 56 and places them in the oven chamber 68 on the empty carrier bar adjacent to load side opening 82. At about the same time, unload side door 90 (FIG. 7) is opened by its actuators 92 exposing load side opening 88. Robotic transfer device 62, preferably similar to device 44, removes the group 60 of carriers on the carrier bar adjacent to the unload side opening 88, placing the group onto the unload side transfer plate 64 (FIG. 2).

Load and unload side doors close and the carriers in group 58 begin their cure process. Meanwhile, carriers continue to arrive on conveyor 38, and yet another group is staged for loading into the oven at the end of the next desired time period, for example the next 240 sec. period. Also, robotic transfer device 66, again, preferably a push ram device, moves carriers from group 60 from the unload side transfer plate 64 onto return conveyor 50 in two groups of 12. The 24 carriers of group 60 are transported on return conveyor 50 to main conveyor 22 at transfer location 26 (FIG. 1) where robotic transfer device 32 transfers one carrier from return conveyor 50 to main conveyor 22 every several seconds, for example every 10 sec. Main conveyor 22 transports the carrier to transfer location 28 where the carrier can be again transferred to another work station 16, for example, for lens finishing.

During the desired time period, such as every 240 seconds, group 58 moves another increment along the runs of conveyor 94, and a new group is loaded into the oven and another group is unloaded from the oven. While the groups are proceeding through the oven chamber, temperature sensors 124 (FIG. 6) are reporting the temperature to the local microprocessor 15 that is adjusting the heating elements 122 to maintain the temperature within the oven at the required temperature for curing the coating on the lenses. Recirculation blowers 126 continue to draw air across the carrier bars 96, sending the recirculating air through supply ducts 132 and 134 and into plenum 136 (FIG. 8). The recirculation air passes through filters 140 before again entering oven chamber 68 to provide heat to cure the lenses.

Intake blower 144 is also operating, drawing in ambient air, filtering the air at intake air filter 150 and sending the filtered air into the oven chamber 68 where it becomes entrained with the recirculating air therein. Exhaust blowers 154 (FIGS. 4 and 5) help to effect the required air exchange between oven chamber 68 and the ambient by drawing air from the oven chamber through troughs 158 and filtering the air at exhaust filters 162 before discharging the air back to the ambient.

It is understood that the foregoing description is intended to describe certain embodiments of the present invention, and is not intended to limit it in any way. This invention is to be read as limited by its claims only.

What is claimed is:

1. An oven for heating a plurality of items in an atmosphere substantially free of particulate contaminants, said oven comprising:

a plurality of side walls defining an enclosed oven chamber;

a heating element for heating the air within said oven chamber;

an intake blower configured to receive air from the ambient and force ambient air into said oven chamber and maintain the air pressure therein at a relatively higher pressure than the pressure of the ambient air;

a first filter operatively associated with said intake blower to filter the air forced into said oven chamber;

an exhaust blower configured to draw air from said oven chamber and exhaust said air to the ambient;

a closeable entrance arranged in one of said side walls for admitting said items to said oven chamber;

a closeable exit arranged in one of said side walls for releasing said items from said oven chamber;

a conveyor located within said oven chamber and adapted to carry said items, said items being movable on said conveyor throughout said oven chamber from a first position adjacent to said entrance to a second position adjacent to said exit and through a plurality of intermediate positions therebetween, said conveyor capable of carrying at least one of said items; and a controller for controlling the motion of said conveyor, said entrance and exit openings said first and second blowers and said heating element.

2. An oven according to claim 1, wherein said conveyor comprises:

a flexible mechanical element housed within an elongated trough, said trough having a ventilation aperture in communication with the air in said oven chamber, said trough being in fluid communication with said exhaust blower such that said exhaust blower draws air from said oven chamber through said trough and exhausts said air to the ambient; and a plurality of carrier bars supported by at least said flexible mechanical element in spaced relation to one another, each of said carrier bars being adapted to support at least one of said items thereon, said flexible mechanical element moving said carrier bars throughout said oven chamber to move said items between said entrance, through said intermediate positions, and to said exit.

3. An oven according to claim 2, wherein said flexible mechanical element comprises a chain.

4. An oven according to claim 1, wherein said conveyor comprises:

a pair of endless chains oppositely disposed in spaced relation, each of said chains being housed within a respective elongated trough, each of said troughs having a plurality of ventilation apertures therein in fluid communication with said oven chamber, said trough being in fluid communication with said exhaust blower, said exhaust blower drawing air from said oven chamber through said troughs and exhausting said air to the ambient; and a plurality of carrier bars suspended between said chains in spaced relation to one another, each of said carrier bars capable of supporting at least one of said items thereon, said chains moving said carrier bars throughout said oven chamber to move said items between said entrance, through said intermediate positions, and to said exit.

5. An oven according to claim 2, wherein said conveyor and said troughs are substantially vertically oriented.

6. An oven according to claim 2, wherein said entrance and said exit are positioned in opposite side walls.

7. An oven according to claim 1, further comprising:

a recirculation blower having an inlet and an outlet, said inlet being in fluid communication with said oven chamber;

a plenum positioned adjacent to and in fluid communication with said oven chamber;

a supply duct extending from said recirculation blower outlet to said plenum;

a recirculation filter operatively associated with said recirculation blower to filter the air recirculated within said oven, said recirculation blower drawing air from said oven chamber and forcing said air through said supply duct, into said plenum, and through said recirculation filter back into said oven chamber, said air thereby being filtered and recirculated within said oven.

8. An oven according to claim 7, wherein said recirculation blower inlet is positioned on one side of said conveyor and said plenum is positioned on an opposite side of said conveyor, said air being recirculated across said conveyor.

9. An oven according to claim 7, wherein said outlet of said intake blower is in fluid communication with said inlet of said recirculation blower.

10. An oven according to claim 7, wherein said heating element is positioned adjacent to said inlet of said recirculation blower.

11. An oven according to claim 1, further comprising a filter in fluid communication with said exhaust blower outlet, said filter filtering the air exhausted from said oven chamber.

12. An oven according to claim 1, further comprising:

a framework positioned within said oven chamber and supporting said conveyor, said framework being supported by a plurality of wheels, said framework being movable on said wheels;

one of said side walls being hingedly mounted on an adjacent side wall thereby forming a door to said oven chamber, said framework being movable on said wheels out of said oven chamber through said door.

13. A process for manufacturing a multiplicity of items, said items being moved one item at a time substantially simultaneously through a plurality of respective work stations at which respective manufacturing steps are effected on each said item, said process including at least one work station through which a plurality of said items moves together as a group, said process comprising the steps of:

moving a plurality of said items to said one work station one item at a time;

accumulating said plurality of items at said one work station to form a group comprising said plurality of items;

admitting said group to said one work station;

performing a manufacturing step on said items of said group at said one work station;

discharging said group from said one work station; and moving said plurality of items comprising said group one item at a time to another of said stations.

14. A process according to claim 13, further comprising the step of moving a plurality of groups through said one work station substantially simultaneously, one group of said plurality being discharged from said one work station as another group of said plurality is admitted to said one work station.

15. A process according to claim 14, wherein said groups are moved through said one work station from a first position wherein each of said groups is admitted to said one work station, through a plurality of intermediate positions, to a second position wherein each of said groups is discharged from said one work station.

16. A process according to claim 15, wherein said groups are moved a stepwise manner between said positions.

17. A process according to claim 16, wherein said items comprise ophthalmic lenses.

18. A process according to claim 17, wherein said manufacturing step at said one work station comprises heating said lenses.

19. A process according to claim 18, wherein said one work station comprises an oven for heating said lenses.

20. A method of heating pluralities of items while maintaining a surface of said items substantially contaminant free, said method comprising the steps of:

(a) providing an oven having an oven chamber adapted to receive said pluralities of said items, said oven chamber having a closeable entrance and a closeable exit;

(b) providing a conveyor located within said oven chamber and capable of transporting said pluralities of items between said entrance and said exit, and through an intermediate position between said entrance and said exit within said oven chamber;

(c) heating the air within said oven chamber;

(d) forcing ambient air into said oven chamber under pressure at a first rate;

(e) filtering the ambient air forced into said oven chamber;

(f) exhausting air from said oven chamber at a second rate lower than said first rate, thereby maintaining the air pressure within said oven chamber at a relatively higher pressure than the ambient air;

(g) opening said entrance;

(h) placing a first plurality of said items onto said conveyor at said first position;

(i) closing said entrance;

(j) transporting said first plurality to said intermediate position on said conveyor;

(k) repeating steps (g) though (j) for a second plurality of said items;

(l) transporting said first plurality of items to said second position and said second plurality of items to said intermediate position;

(m) repeating steps (g) through (j) for a third plurality of said items;

(n) opening said exit;

(o) removing said first plurality of items from said oven chamber;

(p) closing said exit; and steps (c) through (f) being performed simultaneously with one another and with steps (g) through (p).

21. A method of heating an item according to claim 20, wherein said steps (j) and (l) are performed in a stepwise manner between said positions.

22. A method of heating an item according to claim 20, further comprising the step of filtering the air exhausted from said oven chamber.

23. A method of heating an item according to claim 20, further comprising the steps of:

(q) drawing air from said oven chamber;

(r) filtering said air drawn from said oven chamber;

(s) returning said air to said oven chamber; and (t) repeating steps (q) through (s).

24. A method of heating an item according to claim 23, further comprising the step of forcing said ambient air through said recirculation filter before forcing said ambient air through said oven chamber.

* * * * *